US009415959B2

(12) United States Patent
Iwami

(10) Patent No.: US 9,415,959 B2
(45) Date of Patent: Aug. 16, 2016

(54) IMAGE FORMING APPARATUS AND IMAGE FORMING METHOD

(71) Applicant: KYOCERA Document Solutions Inc., Osaka (JP)

(72) Inventor: Naoki Iwami, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/631,046

(22) Filed: Feb. 25, 2015

(65) Prior Publication Data

US 2015/0246782 A1 Sep. 3, 2015

(30) Foreign Application Priority Data

Feb. 28, 2014 (JP) ..... 2014-038405

(51) Int. Cl.

| | |
|---|---|
| ***B65H 3/44*** | (2006.01) |
| ***B65H 7/12*** | (2006.01) |
| ***B65H 1/04*** | (2006.01) |
| ***B65H 7/20*** | (2006.01) |
| ***G03G 15/00*** | (2006.01) |

(52) U.S. Cl.

CPC .. *B65H 3/44* (2013.01); *B65H 1/04* (2013.01); *B65H 7/125* (2013.01); *B65H 7/20* (2013.01); *G03G 15/6508* (2013.01); *B65H 2405/332* (2013.01); *B65H 2511/13* (2013.01); *B65H 2511/414* (2013.01); *B65H 2511/416* (2013.01); *B65H 2515/60* (2013.01); *B65H 2801/06* (2013.01); *G03G 2215/00738* (2013.01); *G03G 2215/00751* (2013.01)

(58) Field of Classification Search

CPC ..... B65H 3/44; B65H 7/125; G03G 15/6508; G03G 15/5029; G03G 2215/00738; G03G 2215/00751; G03G 2215/00734

See application file for complete search history.

(56) References Cited

U.S. PATENT DOCUMENTS

| | | | | |
|---|---|---|---|---|
| 5,130,757 | A * | 7/1992 | Ito | G03G 15/5095 271/9.06 |
| 6,718,145 | B2 * | 4/2004 | Ohta et al. | 399/16 |
| 7,433,645 | B2 * | 10/2008 | Aiyama | G03G 15/6508 399/389 |
| 2010/0310261 | A1 * | 12/2010 | Matsushima | 399/16 |
| 2012/0002223 | A1 * | 1/2012 | Tanaka | B41J 11/00 358/1.9 |

FOREIGN PATENT DOCUMENTS

| | | | |
|---|---|---|---|
| JP | 2003-276856 | | 10/2003 |
| JP | 2007062963 | A * | 3/2007 |
| JP | 2008225052 | A * | 9/2008 |
| JP | 2013147314 | A * | 8/2013 |

* cited by examiner

*Primary Examiner* — Luis A Gonzalez

(74) *Attorney, Agent, or Firm* — Wenderoth, Lind & Ponack, L.L.P.

(57) ABSTRACT

An image forming apparatus includes a paper type detection unit, a paper type determination unit, a paper search unit, and a paper change unit. The paper type detection unit detects a type of a paper conveyed from a paper feeding cassette by a sensor. The paper type determination unit determines whether there is a change in the type of the paper during the printing. The paper search unit searches whether there is an appropriate paper feeding cassette for accommodating papers having paper types equal to types of papers before paper types are changed when there is a change in the type of the paper during the printing as a result of the determination. The paper change unit processes the paper with the changed type and resumes conveyance of papers from the existing appropriate paper feeding cassette when there is the appropriate paper feeding cassette as a result of the search.

5 Claims, 5 Drawing Sheets

IMAGE FORMING APPARATUS AND IMAGE FORMING METHOD

CROSS-REFERENCE TO RELATED APPLICATION

This application is based upon and claims the benefit of priority from Japanese Patent Application No. 2014-038405 filed on Feb. 28, 2014, the entire contents of which are incorporated herein by reference.

BACKGROUND

The present disclosure relates to an image forming apparatus and an image forming method, and more particularly, to an image forming apparatus and an image forming method, by which it is possible to unify the paper types of papers of printed matters.

Conventionally, in an image forming apparatus such as a multifunctional peripheral, a copy machine, and a printer, there are various technologies for detecting the paper type of a paper (a sheet material) and utilizing it for image formation. As one example of these technologies, there has been proposed an image forming apparatus that identifies a paper type of each paper feeding stage by using a media sensor. In this apparatus, the type of a paper material is not set by a user, but is automatically detected in the image forming apparatus and an optimal mode is determined.

SUMMARY

An image forming apparatus according to one aspect of the present disclosure includes a paper type detection unit, a paper type determination unit, a paper search unit, and a paper change unit. The paper type detection unit detects a type of a paper conveyed from a paper feeding cassette by using a sensor during printing. The paper type determination unit determines whether there is a change in the paper type of the paper during the printing. The paper search unit searches whether there is an appropriate paper feeding cassette for accommodating papers having paper types equal to paper types of papers before paper types are changed when there is a change in the paper type of the paper during the printing as a result of the determination. The paper change unit processes the paper with the changed paper type and resumes conveyance of papers from the existing appropriate paper feeding cassette when there is the appropriate paper feeding cassette as a result of the search.

An image forming method according to one aspect of the present disclosure includes a detection step, a determination step, a search step, and a conveyance resumption step. In the detection step, a paper type of a paper conveyed from a paper feeding cassette is detected using a sensor during printing. In the determination step, it is determined whether there is a change in the paper type of the paper during the printing. In the search step, when there is a change in the paper type of the paper during the printing as a result of the determination, it is searched whether there is an appropriate paper feeding cassette for accommodating papers having paper types equal to paper types of papers before paper types are changed. In the conveyance resumption step, when there is the appropriate paper feeding cassette as a result of the search, the paper with the changed type is processed and the conveyance of papers from the existing appropriate paper feeding cassette is resumed.

DETAILED DESCRIPTION

Hereinafter, with reference to the accompanying drawings, an embodiment of an image forming apparatus will be described to facilitate the understanding of the technology of the present disclosure. The following embodiment is an embodied example of the technology of the present disclosure and is not intended to limit the technical scope of the present disclosure. Furthermore, an alphabet S added before a reference number in the flowchart represents a step.

<Image Forming Apparatus>

Figure 1:
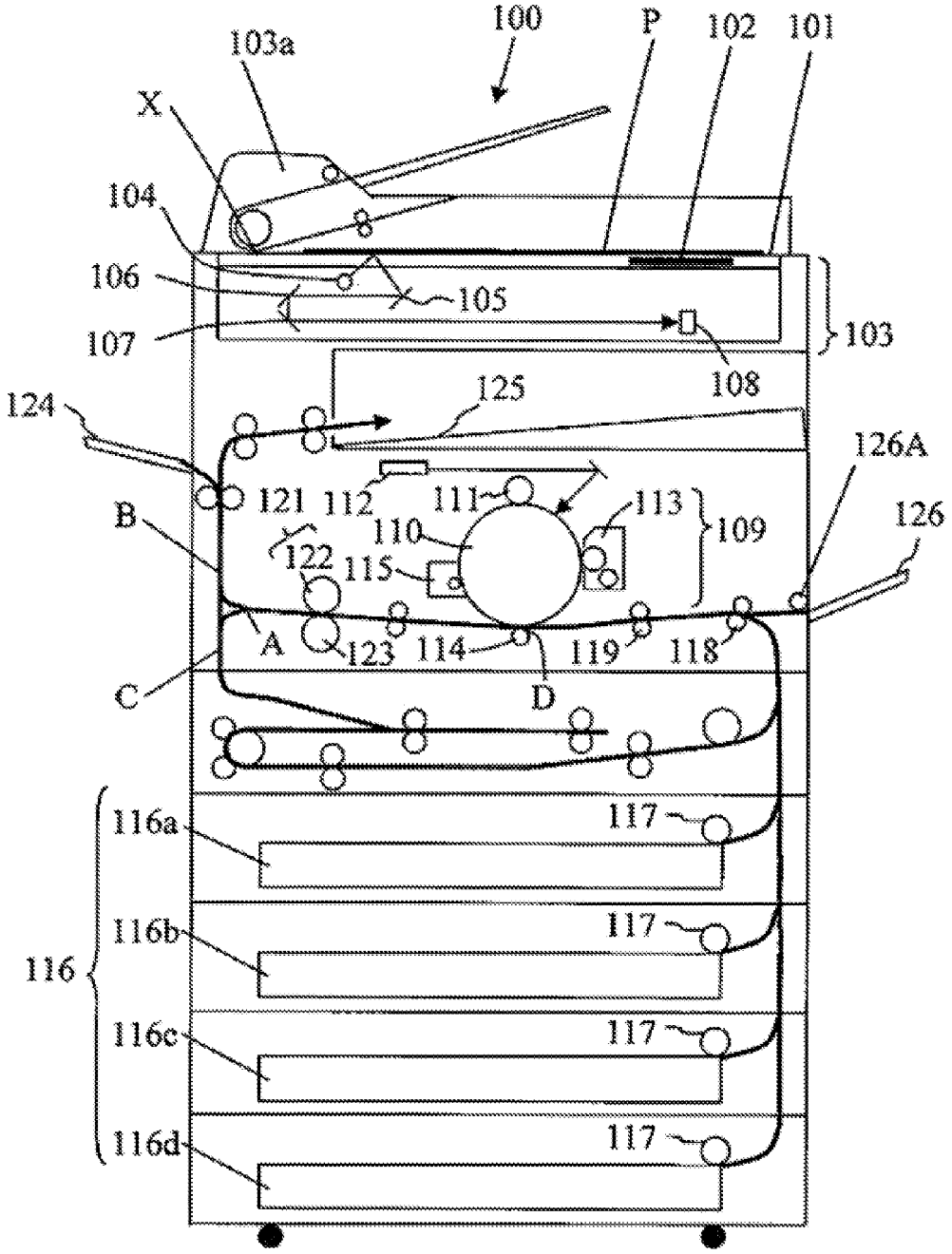
FIG. 1 is a conceptual diagram illustrating an entire internal configuration of a multifunctional peripheral according to the present embodiment.

Hereinafter, an image forming apparatus (for example, a multifunctional peripheral) according to the present embodiment will be described. FIG. 1 is a conceptual diagram illustrating an entire internal configuration of a multifunctional peripheral 100 of the present embodiment. Details of each element having no direct relation with the technology of the present disclosure are omitted.

The multifunctional peripheral 100 of the present embodiment, for example, corresponds to a printer alone, a multifunctional peripheral provided with a printer, a copy, a scanner, a fax and the like. As one example, an operation of the multifunctional peripheral 100 when duplex print processing is performed on images of a document P by using the multifunctional peripheral 100 will be simply described.

Firstly, when a user performs a copy by using the multifunctional peripheral 100, the user places the document P on a document table 101 provided on an upper surface of the multifunctional peripheral 100, and inputs setting (duplex printing, a paper feeding tray and the like) of a copy function from an operating unit 102. Moreover, the user presses down a start key provided in the operating unit 102 and causes the multifunctional peripheral 100 to start the duplex print processing.

When the duplex print processing is started, the multifunctional peripheral 100 starts to read the images drawn on the surfaces of the document P. Firstly, in an image reading unit 103, light irradiated from a light source 104 is reflected from the surface of the document P placed on the document table 101. The reflected light is led to an imaging element 108 by mirrors 105, 106, and 107. The led light is photoelectrically converted by the imaging element 108, and is read as image data of the front surface when the images of the surfaces of the document P are subjected to the duplex printing.

Subsequently, when the user turns over the document P and presses down the start key, the image of the rear surface of the document P is read as image data of the rear surface in the duplex printing similarly to the above. The read image data of the front surface and image data of the rear surface are sent to an image forming unit 109 and are transferred as a toner image.

Furthermore, the image reading unit 103 may also be configured to read the images of both surfaces of the document P by an automatic document paper feeding device 103*a* provided above the image reading unit 103. For example, a document conveyance path formed in a platen cover, and a pickup roller, a conveyance roller and the like included in the platen cover are provided in the automatic document paper feeding device 103*a*, and the document conveyance path is configured to be led from the document table 101 to a paper discharge table via a reading position X at which reading is performed by the image reading unit 103. Furthermore, for example, a predetermined reading member for reading the images of the document P may be configured to be provided at a position facing the image reading unit 103 via the reading position X and to read the images of both surfaces of the document P at the same time.

Meanwhile, a photosensitive drum 110 is provided in the image forming unit 109 to rotate at a constant speed in a predetermined direction, and a charger 111, an exposure unit 112, a developer 113, a transfer unit 114, a cleaning unit 115 and the like are disposed sequentially around the photosensitive drum 110 from an upstream side of a rotation direction.

The charger 111 uniformly electrifies the surface of the photosensitive drum 110. The exposure unit 112 initially irradiates a laser to the electrified surface of the photosensitive drum 110 on the basis of the image data of the front surface, thereby forming an electrostatic latent image. The developer 113 attaches a toner to the conveyed electrostatic latent image to form a toner image. The formed toner image is transferred to a paper by the transfer unit 114. The cleaning unit 115 removes a residual toner remaining on the surface of the photosensitive drum 110. These series of processes are performed by the rotation of the photosensitive drum 110.

The paper is supplied from a plurality of paper feeding cassettes 116 provided in the multifunctional peripheral 100, for example, an upper stage cassette 116*a*, a first intermediate stage cassette 116*b*, a second intermediate stage cassette 116*c*, and a lower stage cassette 116*d*, and different types of papers are accommodated in the plurality of paper feeding cassettes 116. When a paper is conveyed, the paper is drawn out from any one of the paper feeding cassettes 116*a* to 116*d* to a conveyance path by a pickup roller 117. The paper feeding cassettes 116*a* to 116*d*, from which papers are drawn out, are decided on the basis of setting inputted to the operating unit 102 by a user.

The paper drawn to the conveyance path is sent between the photosensitive drum 110 and the transfer unit 114 by a conveying roller 118 and a resist roller 119 such that the toner image based on the image data of the front surface is transferred by the transfer unit 114 and is conveyed to a fixing device 121.

When the paper with the transferred toner image passes through between a heating roller 122 and a pressing roller 123 provided in the fixing device 121, heat and pressure are applied to the toner image, so that the toner image is fixed to the paper and thus the front surface image of the document P is formed on the paper. The heat quantity of the heating roller 122 is optimally set in response to a paper type, so that the fixing is appropriately performed.

The paper with the formed surface image is conveyed to a branch point A most adjacent from the fixing device 121. The branch point A is connected to a conveyance path B for conveying an image-formed paper to a paper discharge tray 124, and a duplex print conveyance path C for duplex printing.

Next, in order to perform image forming processing on the basis of the image data of the rear surface of the document P, the paper with the formed surface image is led to the duplex print conveyance path C, is turned over, and is further conveyed to a transfer point D between the photosensitive drum 110 and the transfer unit 114. Until the paper is conveyed to the transfer point D, a toner image is formed on the photosensitive drum 110 on the basis of the image data of the rear surface. Therefore, when the paper is conveyed to the transfer point D, the toner image of the image data of the rear surface is appropriately transferred to the rear surface of the paper.

When the toner image of the image data of the rear surface is transferred to the rear surface of the paper, the transferred paper is conveyed to the fixing device 121 again, so that fixing is performed and thus the rear surface image of the document P is formed on the paper.

The duplex-printed paper is conveyed from the fixing device 121 to the branch point A, is sent to the conveyance path B leading to the paper discharge tray 124 from the branch point A, and is stacked and accommodated in the paper discharge tray 124.

The multifunctional peripheral 100 is provided at a lateral side thereof with the paper discharge tray 124. However, there is a case in which an in-body tray 125 is also provided in the body of the multifunctional peripheral 100 and a user performs input setting for the operating unit 102 such that a duplex-printed paper may be stacked in the in-body tray 125.

Furthermore, the multifunctional peripheral 100 is provided at a lateral side thereof with a manual feed tray 126 configured to convey stacked papers between the photosensitive drum 110 and the transfer unit 114, and when a user, for example, places a plurality of papers on the manual feed tray 126, inputs a predetermined condition (for example, a selection of paper "manual feed tray") and, presses down the start key, a conveying roller 126A in the vicinity of the manual feed tray 126 is rotated, so that the papers on the manual feed tray 126 are conveyed between the photosensitive drum 110 and the transfer unit 114. As described above, even in the case of papers in addition to papers in a paper feeding tray, the multifunctional peripheral 100 can transfer a toner image on the photosensitive drum 110 to the corresponding papers.

The above is a basic duplex print processing in the multifunctional peripheral 100. In addition, in the multifunctional peripheral 100, a paper is not conveyed to the conveyance path C but is conveyed to the conveyance path B, so that it is possible to perform one side print processing.

Figure 2:
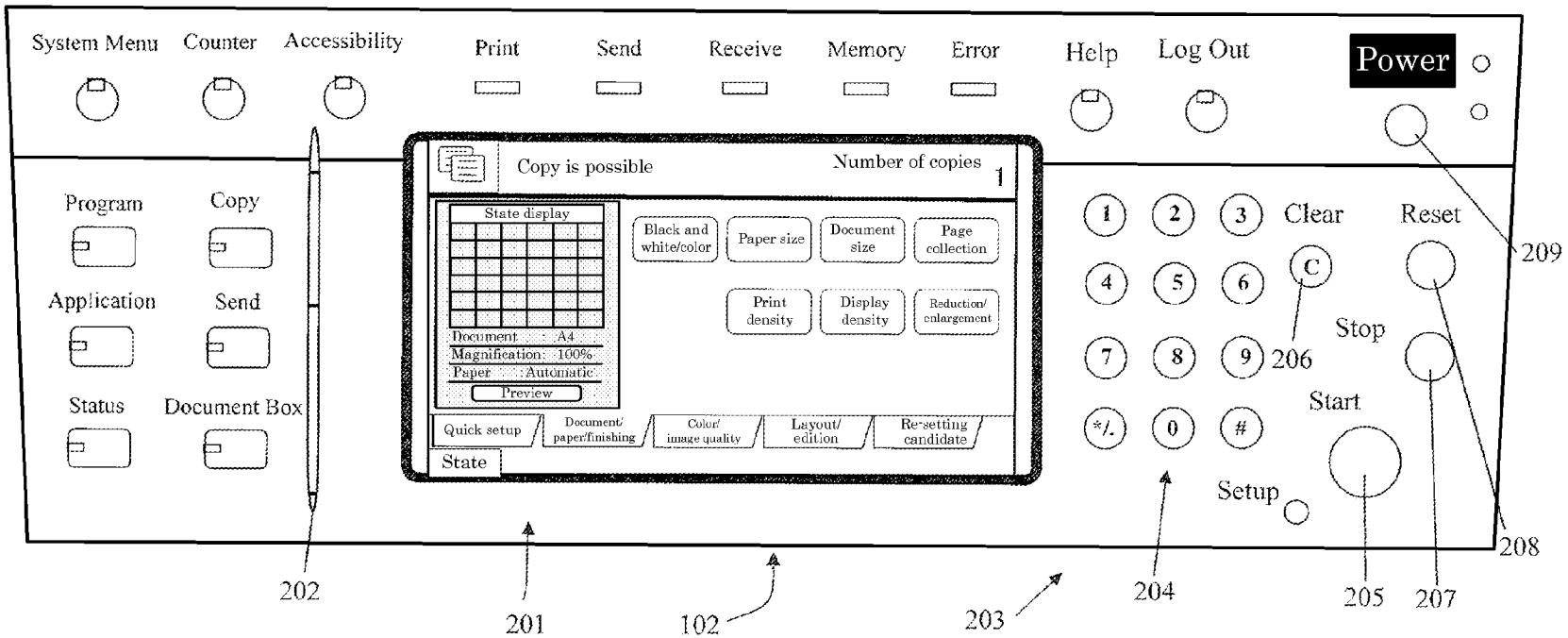
FIG. 2 is a conceptual diagram illustrating an entire configuration of an operating unit according to the present embodiment.

Next, FIG. 2 is a conceptual diagram illustrating an entire configuration of the operating unit according to the present embodiment. A user inputs setting conditions for the aforementioned image formation or confirms the inputted setting conditions by using the operating unit 102. In the case of inputting the setting conditions, a touch panel 201 (an operation panel), a touch pen 202, and operation keys 203 provided in the operating unit 102 are used.

The touch panel 201 has a function of inputting setting conditions and a function of displaying the setting conditions. That is, keys in a screen displayed on the touch panel 201 are pressed down, so that setting conditions corresponding to the depressed keys are inputted.

The touch panel 201 is provided on the rear surface thereof with a display unit (not illustrated) such as LCD (Liquid Crystal Display), wherein the display unit, for example, displays an operation screen of the initial screen and the like. The touch pen 202 is provided in the vicinity of the touch panel 201, and when a user brings a tip of the touch pen 202 into contact with the touch panel 201, a sensor provided under the touch panel 201 detects the contact point.

Moreover, a predetermined number of operation keys 203, for example, a numeric key 204, a start key 205, a clear key 206, a stop key 207, a reset key 208, and a power key 209, are provided in the vicinity of the touch panel 201.

Figure 3:
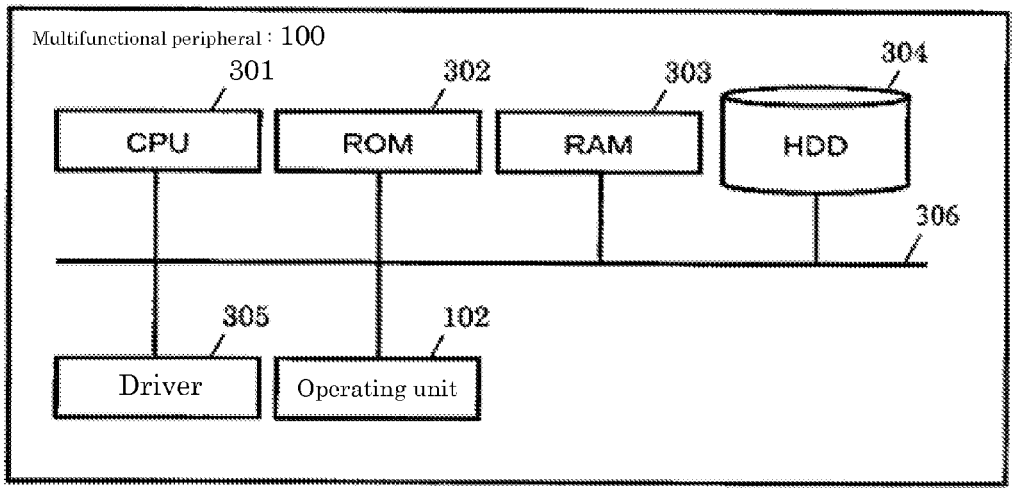
FIG. 3 is a diagram illustrating the configuration of control system hardware of a multifunctional peripheral according to the present embodiment.

Next, with reference to FIG. 3, the configuration of control system hardware of the multifunctional peripheral 100 will be described. FIG. 3 is a diagram illustrating the configuration of the control system hardware of the multifunctional peripheral 100 according to the present embodiment. Details of each element having no direct relation with the technology of the present disclosure are omitted.

In a control circuit of the multifunctional peripheral 100, a CPU (Central Processing Unit) 301, a ROM (Read Only Memory) 302, a RAM (Random Access Memory) 303, a HDD (Hard Disk Drive) 304, a driver 305 corresponding to each driving unit, and the operating unit 102 are connected to one another through an internal bus 306.

The CPU 301, for example, uses the RAM 303 as a working area, executes programs stored in the ROM 302, the HDD 304 and the like, exchanges data, instructions, signals corresponding to keys, commands and the like from the operating unit 102 with the driver 305 on the basis of the execution result, and controls the operations of each driving unit illustrated in FIG. 1.

Furthermore, for the functions (illustrated in FIG. 4) of each element to be described later in addition to the driving units, the CPU 301 executes programs to realize each element. In the ROM 302, the HDD 304 and the like, programs and data for realizing each element to be described below are stored.

PRESENT EMBODIMENT

Figure 4:
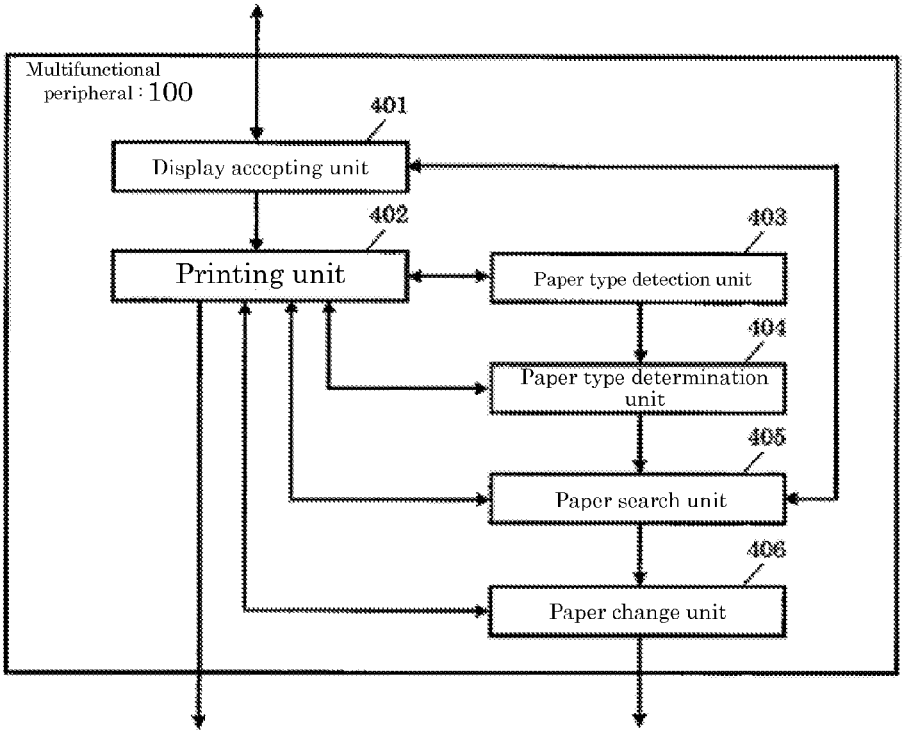
FIG. 4 is a functional block diagram of a multifunctional peripheral according to the present embodiment.
Figure 5:
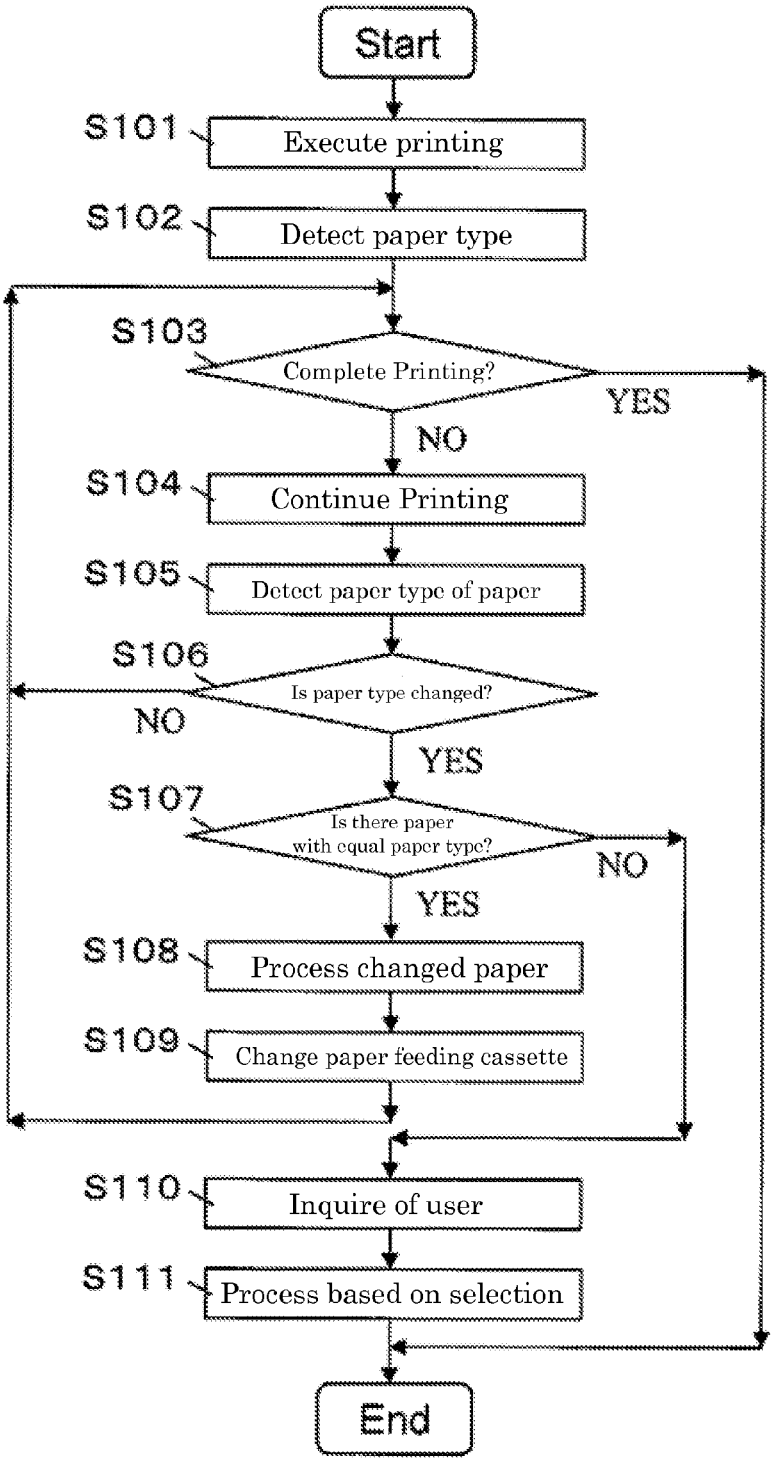
FIG. 5 is a flowchart illustrating an execution procedure of the present embodiment.

Next, with reference to FIG. 4 and FIG. 5, a configuration and an execution procedure according to the present embodiment will be described. FIG. 4 is a functional block diagram of the multifunctional peripheral of the present embodiment. FIG. 5 is a flowchart illustrating an execution procedure of the present embodiment.

Firstly, when the multifunctional peripheral 100 is powered on by a user, the multifunctional peripheral 100 starts to operate and a display accepting unit 401 displays an operation screen on the touch panel 201 as illustrated in FIG. 2. Then, when the user puts the document P on the document table 101, performs a key operation while seeing the operation screen to input a predetermined setting condition (for example, a paper size "A4", a printing number "100", and the like), and presses down the start key 205, the display accepting unit 401 accepts the input of the setting condition and notifies a printing unit 402 of the setting condition. The printing unit 402 having accepted the notification starts printing execution on the basis of the setting condition (FIG. 5: S101).

When the printing unit 402 executes the printing, the printing unit 402 notifies a paper type detection unit 403 of the printing execution. The paper type detection unit 403 having accepted the notification detects the type of a paper conveyed from the paper feeding cassette 116*a* corresponding to the printing execution by using a sensor (FIG. 5: S102).

Methods, in which the paper type detection unit 403 detects a paper type, can be any, but for example, the following method is performed. That is, as illustrated in (A) of FIG. 6, the paper feeding cassette 116 of the multifunctional peripheral 100 is configured to be provided with the pickup roller 117, and to allow papers in the paper feeding cassette 116 to be drawn to a conveyance path when the pickup roller 117 rotates leftward. The drawn papers are guided to the image forming unit 109 via a common conveyance path 600 common to all the paper feeding cassettes 116.

On the common conveyance path 600, a double feeding detection sensor 601, a paper thickness detection sensor 602, and a glossiness detection sensor 603 are disposed from an upstream to a downstream. The double feeding detection sensor 601 detects the double feeding of papers by using an ultrasonic sensor. The paper thickness detection sensor 602 detects the thickness of a paper by using an optical sensor. The glossiness detection sensor 603 detects the glossiness (surface roughness) of a paper by using a media sensor.

In the present embodiment, the paper type detection unit 403 detects the thickness and the glossiness of papers by using the paper thickness detection sensor 602 and the glossiness detection sensor 603, and these are employed as a paper type. Furthermore, when the double feeding has occurred, since it is not possible to appropriately detect the paper type, the paper type detection unit 403 also detects whether the double feeding has occurred in conveyed papers by using the double feeding detection sensor 601.

Meanwhile, the printing unit 402 reads the image data of the document P via the image reading unit 103, selects a paper feeding cassette (for example, the upper stage cassette 116*a*) corresponding to the paper size of the setting condition, and starts to convey papers from the selected paper feeding cassette 116*a*.

In this case, the paper type detection unit 403 starts to operate the double feeding detection sensor 601, the paper thickness detection sensor 602, and the glossiness detection sensor 603, and detects the presence or absence of double feeding of the papers conveyed to the common conveyance path 600 and the types of the papers.

When no double feeding occurs in the papers and the papers appropriately pass through the common conveyance path 600, the paper type detection unit 403 detects the type (thickness and glossiness) of an initial paper, and temporarily stores the detected paper type in a predetermined memory corresponding to the selected paper feeding cassette 116. As described above, during the printing executing, the type of the initial paper is detected, so that it is possible to determine whether there is a change in the types of subsequent papers. Such a configuration, for example, is particularly effective immediately after papers are supplemented in the paper feeding cassettes 116 because a paper type immediately after the supplement is completely obscure.

On the other hand, the printing unit 402 allows the image forming unit 109 to form a toner image corresponding to the image data together with the conveyance of the paper, allows the toner image to be transferred and fixed to the paper, creates a printed matter, and discharges the printed matter to the paper discharge tray 124.

When the printed matter is discharged, the printing unit 402 determines whether a printing number of the printed matter coincides with the printing number of the setting condition, that is, determines whether the printing has been completed (FIG. 5: S103). As a result of the determination, when the printing number of the printed matter does not coincide with the printing number of the setting condition (FIG. 5: S103 NO), the printing unit 402 determines that the printing has not been completed and continues the printing on the basis of the setting condition (FIG. 5: S104).

On the other hand, when the printing is continued, the paper type detection unit 403 detects again the presence or absence of double feeding of papers conveyed to the common conveyance path 600 and the types of the papers (FIG. 5: S105).

When the paper type detection unit 403 detects a plurality of paper types during the (continuous) printing in one printing job, the paper type detection unit 403 notifies a paper type determination unit 404 of the detection result. The paper type determination unit 404 having received the notification determines whether there is a change in the paper types during the printing (FIG. 5: S106).

Methods, in which the paper type determination unit 404 determines whether there is a change in the paper types during the printing, can be any, but for example, the following method is performed. That is, on the basis of the type of an initial paper to be subjected to printing execution, the paper type determination unit 404 determines whether the type of a subsequent (the final) paper previously detected coincides with the type of the initial paper. In detail, the paper type determination unit 404 determines whether the thickness of the type of the subsequent paper is equal to that of the type of the initial paper and the glossiness of the subsequent paper is equal to that of the type of the initial paper. The determination regarding the equality, for example, is performed by determining whether the type of the subsequent paper is within a preset threshold value on the basis of the type of the paper serving as a basis.

In addition to the above, for example, the paper type determination unit 404 may also calculate an average value of paper types detected during the printing execution, and determine whether a detected type of a subsequent paper coincides with the average value. The average value indicates an average value from the type of the initial paper to the types of immediately previous papers of the subsequent paper, except for the type of the subsequent paper.

Furthermore, for example, on the basis of the types of immediately previous papers of the subsequent paper previously detected, the paper type determination unit 404 may also determine whether the type of the subsequent paper coincides with the types of immediately previous papers.

In the present embodiment, a description will be provided for a method for determining whether the detected type of the subsequent paper coincides with the type of the initial paper.

Meanwhile, as a result of the determination, when the thickness of the type of the subsequent paper is equal to that of the type of the initial paper and the glossiness of the subsequent paper is equal to that of the type of the initial paper (FIG. 5: S106 NO), the paper type determination unit 404 determines that there is no change in the paper types during the printing. In this case, the paper type determination unit 404 does not do anything in particular, the procedure returns to S103, and the printing unit 402 conveys the subsequent paper, allows a toner image to be transferred and fixed to the subsequent paper, discharges a printed matter, and determines whether a printing number of the printed matter coincides with the printing number of the setting condition (FIG. 5: S103).

On the other hand, in S106, as the result of the determination, when the thickness of the type of the subsequent paper is not equal to that of the type of the initial paper and the glossiness of the subsequent paper is not equal to that of the type of the initial paper (FIG. 5: S106 YES), the paper type determination unit 404 determines that there is a change in the paper types during the printing, and notifies a paper search unit 405 of the change. The paper search unit 405 having received the notification searches whether there is an appropriate paper feeding cassette 116 for accommodating papers having paper types equal to those of papers before their paper types are changed (FIG. 5: S107).

Methods, in which the paper search unit 405 searches for the appropriate paper feeding cassette 116, can be any, but for example, the following method is performed. That is, since the paper type detection unit 403 temporarily stores the types of papers accommodated in the paper feeding cassettes 116 in memories corresponding to the paper feeding cassettes 116, the paper search unit 405 acquires the types of papers before the type of the subsequent paper, for example, the type of the initial paper, the types of immediately previous papers, and the like from the paper type determination unit 404, and refers to the types of papers of a memory corresponding to another paper feeding cassette 116 in addition to the currently selected paper feeding cassette 116*a*. Then, the paper search unit 405 determines whether the types of papers corresponding to the other paper feeding cassette 116 coincide with the types of previous papers. This determination, for example, is performed by the paper search unit 405 sequentially from the upper stage paper feeding cassette 116, for example, from the first intermediate stage cassette 116*b*. In the present embodiment, for example, it is assumed that all papers with a paper size of "A4" are respectively accommodated in all the paper feeding cassettes 116.

As a result of the determination, when the types of the papers corresponding to the other paper feeding cassette 116 (for example, the second intermediate stage cassette 116*b*) coincide with the types of the previous papers (FIG. 5: S107 YES), the paper search unit 405 determines that the other paper feeding cassette 116 is an appropriate paper feeding cassette and the appropriate paper feeding cassette 116 exists, and notifies a paper change unit 406 of the existence. The paper change unit 406 having received the notification processes the papers with the changed type (FIG. 5: S108) and resumes the conveyance of papers from the existing appropriate paper feeding cassette 116 (FIG. 5: S109).

Methods, in which the paper change unit 406 processes the papers with the changed type, can be any, but for example, the following method is performed. That is, since the papers with the changed type have been already conveyed to the common conveyance path 600, the paper change unit 406 communicates with the printing unit 402 so as not to perform no printing on the papers, and allows the papers to be discharged to a discharge destination (for example, the in-body tray 125) different from a discharge destination (the paper discharge tray 124) of a printed matter. In this way, it is possible to avoid that blank papers mixed in a printed matter.

Figure 6A:
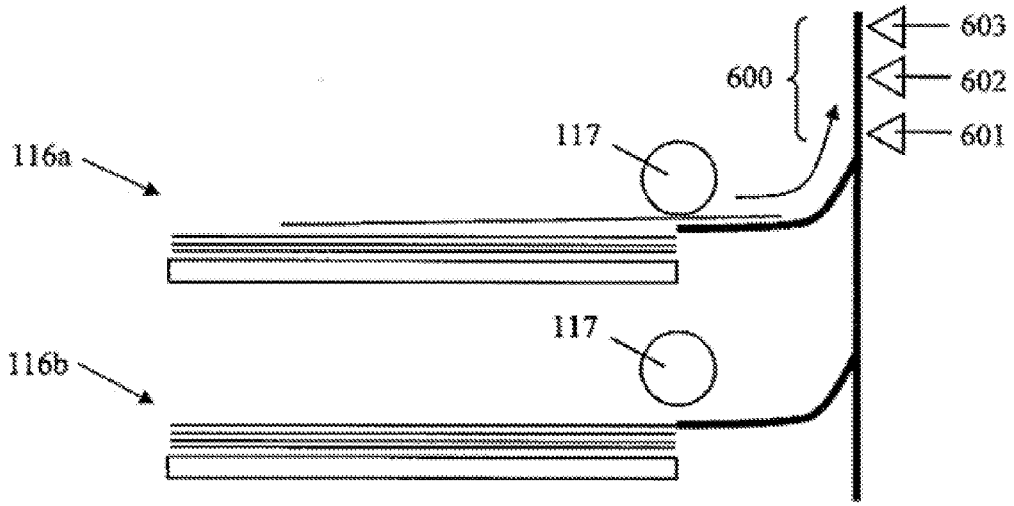
FIG. 6A is a diagram illustrating a relation between a common conveyance path including sensors and paper feeding cassettes in the present embodiment.
Figure 6B:
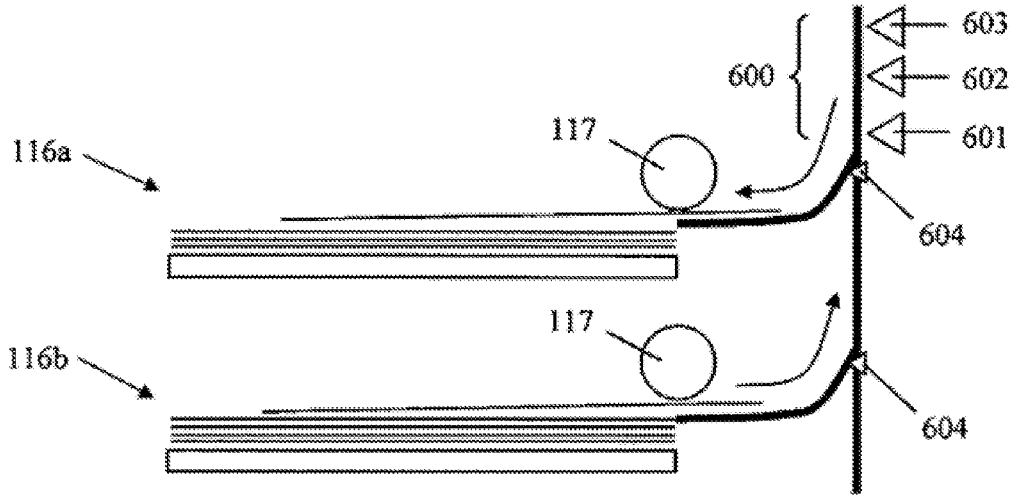
FIG. 6B is a diagram illustrating the reverse conveyance of a paper and the resumption of conveyance of a paper in the present embodiment.

In addition to the above, for example, as illustrated in (B) of FIG. 6, a branch part 604 for switching conveyance paths of papers drawn out from the paper feeding cassettes 116 and the common conveyance path 600 is provided for each paper feeding cassette 116, the paper change unit 406 starts to operate the branch part 604 of the selected paper feeding cassette 116*a* such that papers are conveyed from the common conveyance path 600 to the paper feeding cassette 116*a* in a one-way direction, and allows the conveying roller 118 to be reversely rotated such that the papers with the changed type are reversely conveyed. In this way, the papers with the changed type can be returned to the original paper feeding cassette 116*a*.

In the case of reversely conveying the paper with the changed type, for example, the paper change unit 406 may send the corresponding papers already conveyed to the common conveyance path 600 to the duplex print conveyance path C by using the duplex print conveyance path C, return the corresponding papers to the positions of the conveying roller 118 and the like, and then reversely rotate the conveying roller 118 such that the papers with the changed type are reversely conveyed.

Methods, in which the paper change unit 406 resumes the conveyance of papers from another specific paper feeding cassette 116, can be any, but for example, the following method is performed. That is, the paper change unit 406 communicates with the printing unit 402 so as to change the already selected paper feeding cassette 116*a* to an appropriate paper feeding cassette 116*b*, and allow the conveyance of papers to be resumed from the appropriate paper feeding cassette 116*b* in subsequent printing execution. In this way, during the printing execution, even though there is a change in the types of papers due to certain factors, it is possible to continue printing on papers with equal types.

In the case of reversely conveying the papers with the changed type by the paper change unit 406, when the papers with the changed type have been already accommodated in the already selected paper feeding cassette 116*a* as illustrated in (B) of FIG. 6, the paper change unit 406 starts to operate the branch part 604 of the already selected paper feeding cassette 116*a* such that a connection to the common conveyance path 600 from the paper feeding cassette 116*a* is blocked, and starts to operate the branch part 604 of the changed appropriate paper feeding cassette 116*b* such that papers are conveyed from the appropriate paper feeding cassette 116*b* to the common conveyance path 600 in one direction. In this way, it is possible to reliably prevent a conveyance error of papers.

Meanwhile, when a change of paper conveyance to the appropriate paper feeding cassette 116 is completed, the procedure returns to S103 and the printing unit 402 conveys a paper from the appropriate paper feeding cassette 116, allows a toner image to be transferred and fixed to the paper, discharges a printed matter, and determines whether a printing number of the printed matter coincides with the printing number of the setting condition (FIG. 5: S103).

Meanwhile, as the result of the determination in S107, when the types of the papers corresponding to all the other paper feeding cassettes 116 do not coincide with the types of the previous papers (FIG. 5: S107 NO), the paper search unit 405 determines that no appropriate paper feeding cassette 116 exists, and notifies the display accepting unit 401 of the absence. The display accepting unit 401 having received the notification allows an alert screen indicating a change in a paper type on the touch panel 201 and inquires of a user whether to continue the printing (FIG. 5: S110). On the alert screen, for example, a continuation key for continuing printing and a stop key for stopping the printing are selectably displayed. Moreover, on the alert screen, the type (thickness and glossiness) of a paper before being changed and the type (thickness and glossiness) of the paper after being changed may also be displayed.

The display accepting unit 401 performs processing in correspondence to the selection of a user (FIG. 5: S111). In detail, when a user having seen the alert screen, for example, presses down the continuation key, the display accepting unit 401 accepts the continuation key and notifies the printing unit 402 of the selection of the continuation key, and the printing unit 402 having received the notification continues printing on papers from the selected paper feeding cassette 116*a*. On the other hand, when the user, for example, presses down the stop key, the display accepting unit 401 accepts the stop key and the printing unit 402 stops all the printing. In this way, the user can determine the continuation or stop of printing in response to printing states or use states.

Meanwhile, as a result of the continuation of the printing, in S103, the printing unit 402 determines whether the printing number of the printed matter coincides with the printing number of the setting condition (FIG. 5: S103), and as the result of the determination, when the printing number of the printed matter coincides with the printing number of the setting condition (FIG. 5: S103 YES), the printing unit 402 completes the printing and completes all processes.

Meanwhile, in the case in which the paper type detection unit 403 detects the type of the paper (FIG. 5: S102), when the double feeding has occurred in the papers conveyed to the common conveyance path 600, since the values of the paper thickness detection sensor 602 and the glossiness detection sensor 603 are changed as compared with these values of the type of one paper, the paper type detection unit 403 does not detect the types of papers by using the paper thickness detection sensor 602 and the glossiness detection sensor 603, and notifies the display accepting unit 401 of the occurrence of the double feeding. The display accepting unit 401 having received the notification allows a double feeding removing screen for removing the double feeding to be displayed on the touch panel 201, for example, thereby urging the removing of the double feeding by a user. Furthermore, when papers are doubly feeded, the printing unit 401 suspends the execution of printing.

As described above, the present embodiment includes the paper type detection unit 403 that detects the types of papers conveyed from the paper feeding cassettes by using sensors during printing, the paper type determination unit 404 that determines whether there is a change in the types of the papers during the printing, the paper search unit 405 that searches whether there is an appropriate paper feeding cassette for accommodating papers having paper types equal to those of papers before their paper types are changed when there is a change in the types of the papers during the printing as a result of the determination, and the paper change unit 406 that processes the papers with the changed type and resumes the conveyance of papers from the existing appropriate paper feeding cassette when there is the appropriate paper feeding cassette as a result of the search. In this way, it is possible to unify the types of papers of printed matters. Particularly, it is especially effective in the case of printed matters intended not to change paper types during printing such as distribution materials.

Furthermore, the present embodiment employs a configuration in which control from the detection of the types of the papers to the resumption of the conveyance of the papers is performed with respect to all users; however, other configurations may also be employed. For example, since there are users desiring no change in paper types and users unconcerned with paper types, it may be possible to employ a configuration of switching whether to perform the control in response to the selection of a predetermined key (for example, a paper type change prevention key) by a user. Furthermore, it may be possible to employ a configuration of associating identification information of users with the presence or absence of the execution, storing the association result in a predetermined memory in advance, and automatically switching the execution of the control in correspondence to printing jobs of users.

Furthermore, the present embodiment employs a configuration of determining whether the type of a subsequent paper is within a preset threshold value on the basis of the type of a paper serving as a reference with respect to all users; however, other configurations may also be employed. For example, since preferences for paper types differ in users as described above, it may be possible to employ a configuration in which the threshold value is allowed to be set by the users in advance, and the accuracy of determination regarding whether there is a change in the paper types during the printing is increased or decreased.

Furthermore, the present embodiment employs a configuration of, in printing execution, detecting the type of an initial paper, storing the detected type, and determining whether there is a change in the type of a subsequent paper with respect to all printing jobs; however, other configurations may also be employed. For example, since the types of papers are changed immediately after papers are supplemented in the paper feeding cassettes 116 in most cases, it may be possible to employ a configuration in which the detection of the type of the initial paper, for example, is performed when papers have been conveyed from the paper feeding cassettes immediately after papers are supplemented therein. In this way, at the timing at which paper types are changed, it is possible to reliably determine a change in the types of papers during printing.

Furthermore, the present embodiment employs a configuration in which the multifunctional peripheral 100 includes each element (referring to FIG. 4). However, it may be possible to employ a configuration in which programs for realizing each element are stored in a recording medium and the recording medium is provided. In this configuration, the multifunctional peripheral 100 reads the programs and realizes each element. In this case, the programs itself read from the recording medium cause the operations and effects of the present embodiment. Moreover, it may also be possible to provide a method for storing steps executed by each element in a hard disk.

As described above, the image forming apparatus and the image forming method of the technology of the present disclosure are useful in a copy machine, a printer and the like as well as a multifunctional peripheral, and are useful as an image forming apparatus and an image forming method, by which it is possible to unify the types of papers of printed matters.

What is claimed is:

1. An image forming apparatus comprising:

a plurality of paper feeding cassettes that accommodate paper;

a conveyance path for paper drawn out from each of the paper feeding cassettes;

a common conveyance path that is provided in common to each of the paper feeding cassettes and includes a conveying roller conveying the paper conveyed from the conveyance path of each of the paper feeding cassettes;

a branch part that switches between each of the conveyance paths drawn out from each of the paper feeding cassettes;

a double feeding detection sensor, a paper thickness detection sensor, and a glossiness detection sensor that are provided at the common conveyance path on a downstream side of the branch part in a direction of conveyance for printing, from an upstream side to the downstream side in the direction of conveyance for printing in this order;

a paper type detection unit that detects a type of the paper during printing with the paper thickness detection sensor and the glossiness detection sensor, when the double feeding detection sensor detects that there is no double feeding of the paper having passed through the common conveyance path;

a paper type determination unit that determines whether there is a change in the type of the paper during the printing;

a paper search unit that searches for whether there is an appropriate paper feeding cassette that accommodates paper having a paper type equal to the type of paper before the paper type is changed when there is a change in the type of the paper during the printing as a result of the determination; and a paper change unit that executes predetermined processing to the paper with the changed paper type and resumes conveyance of paper from the existing appropriate paper feeding cassette when there is the appropriate paper feeding cassette as a result of the search, wherein the paper change unit executes processing of returning the paper with the changed type to its original paper feeding cassette via the conveyance path leading to the paper feeding cassette by starting to operate the branch part and reversely rotating the conveying roller such that the paper with the changed type is reversely conveyed as the predetermined processing.

2. The image forming apparatus of claim 1, wherein the paper type determination unit performs any one of determining whether a type of a subsequent paper coincides with a type of an initial paper on the basis of the type of the initial paper to be subjected to printing execution, determining whether the type of the subsequent paper coincides with an average value of types of papers detected during the printing execution, and determining whether the type of the subsequent paper coincides with a type of an immediately previous paper to the subsequent paper on the basis of the type of the immediately previous paper.

3. The image forming apparatus of claim 1, further comprising:

a display accepting unit that displays an alert screen indicating a change in a paper type when there is no another specific paper feeding cassette as the result of the search, inquires of a user whether to continue the printing, and allows processing to be performed in correspondence to a selection of the user.

4. The image forming apparatus of claim 3, wherein the display accepting unit displays, when there is a change in the type of the paper, a paper thickness detected by the paper thickness detection sensor and a glossiness of the paper detected by the glossiness detection sensor before and after the change in the type of the paper.

5. An image forming method of an image forming apparatus comprising:

a plurality of paper feeding cassettes that accommodate paper;

a conveyance path for paper drawn out from each of the paper feeding cassettes;

a common conveyance path that is provided in common to each of the paper feeding cassettes and includes a conveying roller conveying the paper conveyed from the conveyance path of each of the paper feeding cassettes;

a branch part that switches between each of the conveyance paths drawn out from each of the paper feeding cassettes;

a double feeding detection sensor, a paper thickness detection sensor, and a glossiness detection sensor that are provided at the common conveyance path on a downstream side of the branch part in a direction of conveyance for printing, from an upstream side to the downstream side in the direction of conveyance for printing in this order, wherein the image forming method comprises:

a first step of detecting a type of the paper with the paper thickness detection sensor and the glossiness detection sensor during printing, when the double feeding detection sensor detects that there is no double feeding of the paper having passed through the common conveyance path;

a second step of determining whether there is a change in the type of the paper during the printing;

a third step of searching for whether there is an appropriate paper feeding cassette that accommodates paper having a paper type equal to the type of paper before the paper type is changed when there is a change in the type of the paper during the printing as a result of the determining; and a fourth step of executing predetermined processing to the paper with the changed type and resuming conveyance of the paper from the existing appropriate paper feeding cassette when there is the appropriate paper feeding cassette as a result of the searching, wherein the fourth step includes a step of executing processing of returning the paper with the changed type to its original paper feeding cassette via the conveyance path leading to the paper feeding cassette by starting to operate the branch part and reversely rotating the conveying roller such that the paper with the changed type is reversely conveyed as the predetermined process.

* * * * *